US009895916B2

(12) United States Patent
Elferink et al.

(10) Patent No.: US 9,895,916 B2
(45) Date of Patent: Feb. 20, 2018

(54) PRINT HEAD SUPPORT ASSEMBLY AND INKJET PRINTER COMPRISING SUCH ASSEMBLY

(71) Applicant: Océ Holding B.V., Venlo (NL)

(72) Inventors: Maarten J. H. Elferink, Vancouver (CA); Serguei Makarevski, North Vancouver (CA)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/442,315

(22) Filed: Feb. 24, 2017

(65) Prior Publication Data

US 2017/0259596 A1 Sep. 14, 2017

(30) Foreign Application Priority Data

Mar. 8, 2016 (EP) ..... 16159084

(51) Int. Cl.
*B41J 25/304* (2006.01)
*B41J 25/308* (2006.01)
*B41J 19/00* (2006.01)

(52) U.S. Cl.
CPC ..... *B41J 25/3086* (2013.01); *B41J 19/00* (2013.01); *B41J 25/304* (2013.01); *B41J 25/308* (2013.01); *B41J 25/3082* (2013.01)

(58) Field of Classification Search
CPC .... B41J 2/14024; B41J 2/2135; B41J 25/001; B41J 25/304; B41J 25/308; B41J 25/316; B41J 25/3086; B41J 25/3082
See application file for complete search history.

(56) References Cited

U.S. PATENT DOCUMENTS 8,905,520 B2 * 12/2014 Mercade ..... B41J 25/3086 347/49
9,126,445 B1 * 9/2015 Spence ..... B41J 25/34
2008/0180473 A1 7/2008 Gardner et al.
2008/0273910 A1 11/2008 Verlinden et al.

FOREIGN PATENT DOCUMENTS

EP 1 488 930 A2 12/2004
EP 2 679 393 A1 1/2014
WO WO 2015/144574 A2 * 10/2015

* cited by examiner

*Primary Examiner* — Geoffrey Mruk
(74) *Attorney, Agent, or Firm* — Birch, Stewart, Kolasch & Birch, LLP

(57) ABSTRACT

In a print head support assembly for carrying a number of print heads and for positioning the number of print heads, the print head support assembly includes a carriage plate provided with reference elements for positioning the number of print heads, the carriage plate being further provided with at least four support positions and a support sub-assembly provided with at least four adjustable mounting points for coupling to said at least four support positions and for supporting the carriage plate at said at least four support positions. The support sub-assembly is configured to constrain the carriage plate in six degrees of freedom with respect to a position of the carriage plate and to constrain the carriage plate in at least one degree of freedom with respect to a shape of the carriage plate. Thus, a light-weight and compliant carriage plate may be used to provide for a light-weight carriage suitable for high-speed printing.

11 Claims, 6 Drawing Sheets

PRINT HEAD SUPPORT ASSEMBLY AND INKJET PRINTER COMPRISING SUCH ASSEMBLY

FIELD OF THE INVENTION

The present invention generally pertains to a print head support assembly for supporting a number of print heads and for positioning such number of print heads. Further, the present invention relates to an inkjet printer comprising such assembly.

BACKGROUND ART

It is known to provide a printer, in particular an inkjet printer having an array of print heads in a scanning carriage. The carriage is arranged for scanning over a recording medium support surface to provide droplets of ink in adjacent swaths to form a printed image on a recording medium. In order for the swaths to be adjacent, it is known to transport the recording medium between subsequent swaths and it is known to arrange the scanning carriage on a gantry that is moveable in a transport direction perpendicular to a scanning direction.

The moving carriage requires accurate movement control to provide for a sufficient image quality. On the other hand, printing speed is ever desired to increase. Therefore, it is always desired to reduce a weight of the carriage which allows for higher scanning speed and to increase the number of print heads supported by the carriage as such increase enables to print a wider swath in a single scanning operation.

SUMMARY OF THE INVENTION

In an aspect of the present invention, a print head support assembly according to claim 1 is provided. The print head support assembly according to the present invention is configured for carrying a number of print heads and for positioning the number of print heads relative to the print head support assembly and thus indirectly relative to each other. The print head support assembly comprises a carriage plate provided with reference elements for positioning the number of print heads and the carriage plate is further provided with at least four support positions. The print head support assembly further comprises a support sub-assembly. The support sub-assembly supports the carriage plate and is provided with at least four mounting points, wherein the at least four mounting points are coupled to said at least four support positions. The support sub-assembly is configured to constrain the carriage plate in six degrees of freedom with respect to a position of the carriage plate and to constrain the carriage plate in at least one degree of freedom with respect to a shape of the carriage plate. In accordance with the present invention, a position of at least one of the mounting points is adjustable for adjusting the shape of the carriage plate.

As well known in the art, for mechanically positioning an element, it should be constrained in six degrees of freedom: a translation in each of three dimensions (Tx, Ty, Tz), commonly referred to as the X-direction, Y-direction and Z-direction and a rotation around each of the mentioned three dimensions (Rx, Ry, Rz). These six degrees of freedom relate to the position of the carriage plate. Each degree of freedom should be constrained only once, otherwise the mounting is over-constrained which may result in a loss of control of the position and undesired stress in the mechanical assembly.

In the present invention, however, the carriage plate is selected to be compliant to a predetermined extent. The compliancy in the carriage plate is introduced due to a weight reduction. The weight reduction is achieved by thinning of the carriage plate compared to a prior art carriage plate, which prior art carriage plate is so thick that the carriage plate may be treated as stiff. As used herein, a carriage plate may be treated as stiff, if the weight of supported print heads and any other forces on the carriage plate do not result in a deformation of the carriage plate that affects the droplet positioning to the extent that the resulting image quality becomes unacceptable.

In the present invention, a carriage plate is employed that—if it would be treated as stiff and hence only supported at three support positions for constraining the six degrees of freedom—the carriage plate would not necessarily be sufficiently flat for obtaining sufficient image quality.

Moreover, the machining of the carriage plate to a thin and light-weight plate is usually performed in a clamped state. In the clamped state, the plate is machined on one side, removing an amount of material and thereby changing the mechanical properties such as the internal stresses in the plate. As a result, after releasing the plate from the clamped state, the carriage plate is usually warped. The warped state is of course resulting in a skewed positioning of print heads and consequently in misdirection of droplets. While such warped state is undesirable, the corresponding weight reduction is desirable. Knowing that the warping results from the fact that the carriage plate has an internal degree of freedom, i.e. a degree of freedom with respect to its shape, due to its reduced weight, the presence of the internal degree of freedom may be advantageously employed in the present invention.

In the present invention, the print head support assembly is not only configured to constrain, but also to adapt to the above-mentioned internal degree of freedom such to arrive at a substantially flat carriage plate in a desired position. Thereto, the carriage support plate is provided with at least four support positions and the support sub-assembly is provided with a corresponding number of at least four mounting points for coupling to and supporting the carriage plate. While three support positions are needed for constraining the six degrees of freedom with respect to the position, the fourth support position is provided for constraining the internal degree of freedom, i.e. the degree of freedom with respect to the shape. In accordance with the present invention, at least one of the at least four mounting points is adjustable in its position such to enable to adjust to and constrain the internal degree of freedom. In an embodiment, at least three of the at least four mounting points is adjustable in its position not only to enable to adjust to and constrain the internal degree of freedom, but also to enable to adjust and hold the carriage plate in its position in said six degrees of freedom with respect to the position of the carriage plate.

It is noted that more support positions and/or mounting points may be provided depending on the specific construction and linkages used. Still, in the present invention, at the support positions the carriage plate is supported or suspended, meaning that the translation in the vertical direction is controlled. With three such support positions, the position of a stiff plate is determined in the vertical direction and thus constrained.

Introducing a fourth support position results in an over-constrained design, if the carriage plate would be stiff. The compliancy of the carriage plate in a direction perpendicular to the carriage plate is however an additional degree of freedom, which can be controlled and constrained—without over-constraining—by such additional support position.

On the other hand, with only one additional support position as compared to the three support positions needed for constraining the position of a stiff carriage plate, the carriage plate according to the present invention is required to have a certain minimum amount of stiffness. In other words, the compliancy of the carriage plate should be limited. This will be described, discussed and elucidated hereinafter. Depending on the actual compliancy of the carriage plate, more internal degrees of freedom may be present. In order to control such additional internal degrees of freedom, additional support positions may be introduced. However, with an increasing number of support positions, an increasing number of (adjustable) mounting points on the support sub-assembly need to be provided. With such increasing number of mounting points, the support sub-assembly becomes larger and more complex. Hence, a trade-off between, on the one hand, weight and compliancy of the carriage plate and, on the other hand, weight and complexity of the support sub-assembly needs to be made.

In a simple and practical embodiment, the support sub-assembly comprises a first support structure providing for two adjustable mounting points and a second support structure providing for two further adjustable mounting points. Thus, four independent mounting points are provided, although the adjustment mechanism may be designed such that adjusting one of the mounting points affects the relative position between the two mounting points.

In a particular embodiment, the number of print heads is arranged on the carriage plate in a number of staggered rows, each row comprising at least one print head and extending in a row direction, and wherein the two adjustable mounting points of at least one of the first and second support structure are arranged on a virtual line parallel to the row direction. In such particular embodiment, said support structure or both support structures may be designed as plate-like structures that may easily be arranged between the staggered print heads.

In an embodiment, the at least one degree of freedom with respect to the shape allows the carriage plate to be warped and the support sub-assembly is configured to constrain the carriage plate in a substantially flat shape for correcting such warped state. As above mentioned, thinning a plate is usually performed while clamping a thick plate and removing a predetermined amount of material by e.g. drilling, milling, sawing, and the like. After such machining, the thinned plate is released from clamping and usually it will then be warped. The present invention is very suitable to correct and compensate such warped state, which may be considered to be an internal degree of freedom. Hence, the present invention enables to use such cost-effectively thinned plate as a carriage plate on which a number of print heads is supported.

Similarly, a thinned plate may be bent. In other words, the at least one degree of freedom with respect to the shape may allow the carriage plate to bend. Then, in an embodiment, the support sub-assembly is configured to constrain the carriage plate in a substantially flat shape for correcting such bent state.

In either of the above mentioned embodiments, wherein the carriage plate may be warped or bent, the number of print heads and the at least four support positions may be arranged relative to each other such that a static weight distribution exerted on the carriage plate by a mass of the number of print heads forces the carriage plate into a substantially flat shape. Suitably selecting the support positions on the carriage plate with respect to the positions of the print heads may assist to properly balance and straighten the carriage plate.

In a further aspect the present invention provides an inkjet printer comprising a recording medium support surface, a carriage guiding structure and a carriage arranged to be moveable along the carriage guiding structure over the recording medium support surface. In the inkjet printer, the print head support assembly according to the present invention is mounted in the carriage and is mechanically coupled to the carriage by at least one coupling element. The coupling element provides for a mechanical stiffening of the carriage as a whole without affecting the position and shape of the carriage plate. In an embodiment, the carriage plate is provided with measurement structures for enabling a measurement of a distance between the carriage plate and the recording medium support surface. In view of the adjustability of the support sub-assembly, the carriage plate shape and position may be adjusted and calibrated after mounting in the inkjet printer. For example, a distance between a nozzle orifice and a recording medium is very important with respect to droplet positioning and thus with respect to image quality. For ease of calibration, the carriage plate may be provided with measurement elements. For example, a recess for receiving a gauge may be provided. In particular and preferably, such measurement elements are provided near each of the support positions such that the adjustments may be performed while measuring and until the support positions are all positioned correctly within a predetermined specification of allowable inaccuracy.

In an aspect, the present invention further provides an inkjet printer provided with a print head support assembly according to the present invention, wherein the inkjet printer comprises a recording medium support surface and a carriage arranged over the recording medium support surface. The print head support assembly is mounted in the carriage and is mechanically coupled to the carriage by at least one coupling element. The print head support structure according to the present invention may as well be employed in a printer having stationary arranged print heads, such as well-known page-wide print head arrays. Usually, in such printers, the recording medium and the stationary print head array are moveable relative to each other in only one direction, commonly referred to as a medium transport direction. In such embodiment, the recording medium may be transported, for example from a medium supply roll to a medium receiving roll. Still, in another embodiment, the print head array may be stationary in the scanning direction, but may be moved in the medium transport direction while extending over the full width of the medium support surface.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIG. 10 shows a perspective view of a second embodiment of an inkjet printer;

DETAILED DESCRIPTION OF THE DRAWINGS

Figure 1A:
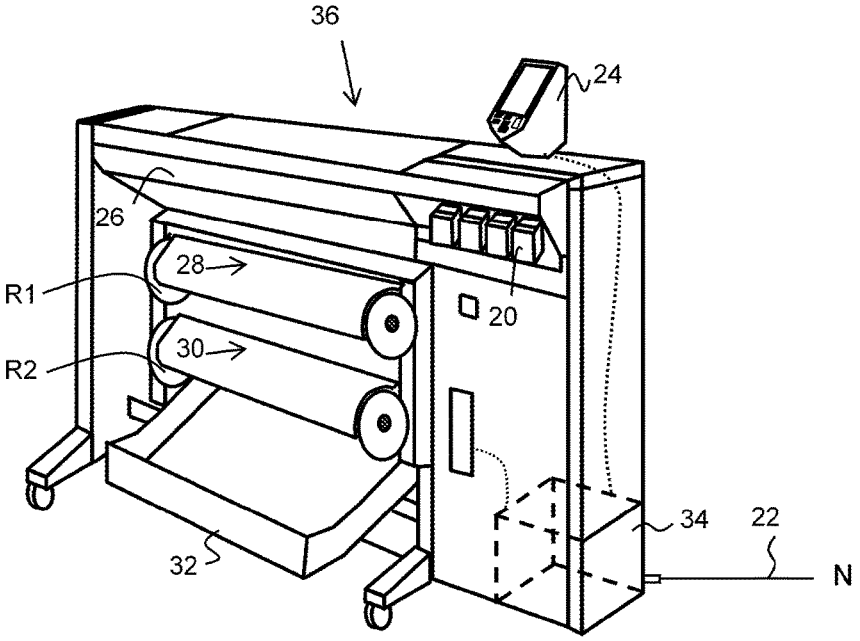
FIG. 1A shows a perspective view of a first embodiment of an inkjet printer.

The present invention will now be described with reference to the accompanying drawings, wherein the same reference numerals have been used to identify the same or similar elements throughout the several views.

Figure 1B:
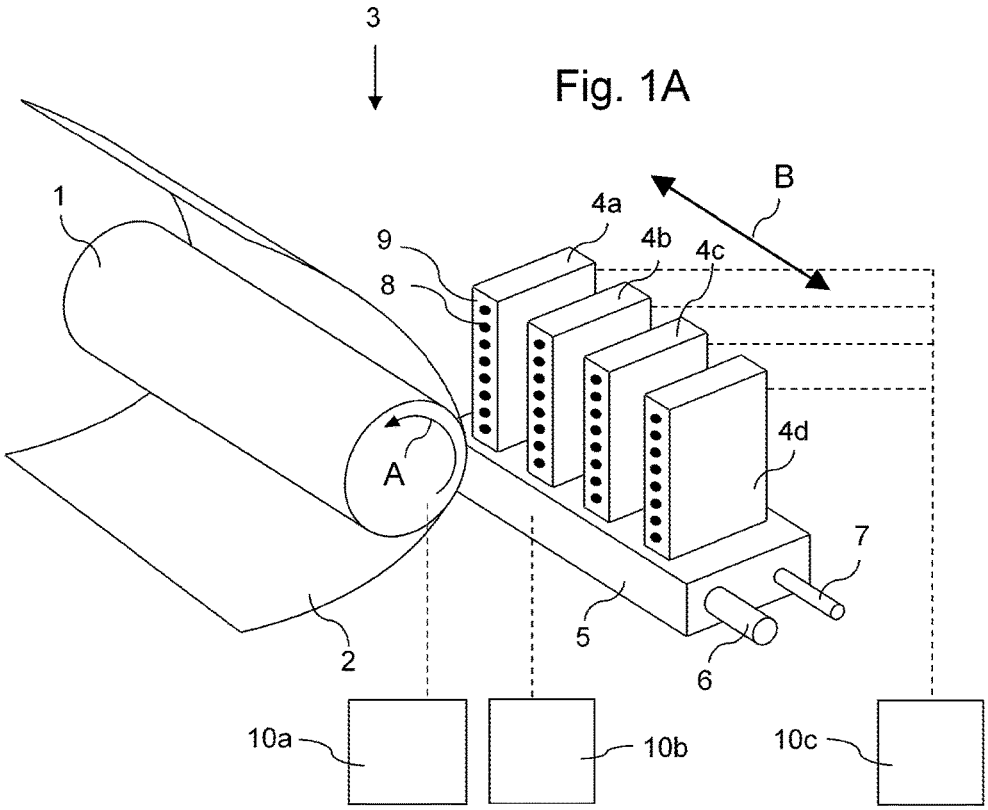
FIG. 1B shows a schematical perspective representation of a scanning inkjet printing assembly.

FIG. 1A shows an image forming apparatus 36, in particular an inkjet printer, wherein printing is achieved using a wide-format inkjet printing assembly. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30 (also referred to as a recording medium), a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

FIG. 10 shows another embodiment of an inkjet printing assembly 14 (herein also referred to as a printing apparatus or an inkjet printer), in which the medium support surface 1 is a flat surface. On the flat surface a flexible medium or a non-flexible flat medium may be arranged and may be printed on. The medium support surface 1 is supported on a suitable support structure 12 and a guide beam 16 is arranged over the medium support surface 1. Such guide beam 16 is also known in the art as a gantry.

The guide beam 16 supports the print head carriage 5 such that the print head carriage 5 is enabled to scan in a Y-direction. The guide beam 16 is arranged and configured to be enabled to reciprocate in an X-direction, wherein the X-direction is usually substantially perpendicular to the Y-direction. In a known printing apparatus 14, the guide beam 16 is also arranged and configured to be enabled to move in a Z-direction, which is substantially perpendicular to the X-direction and the Y-direction such to enable to adapt the printing apparatus 14 to a thickness of the recording medium being arranged on the medium support surface 1 and/or to be enabled to print multiple layers on top of each other such to generate height differences in a printed image.

While in FIG. 1B the carriage 5 is illustrated to support four print heads 4*a*-4*d*, in practice the carriage 5 may support many print heads. For example, more than four colors of liquid marking material (hereinafter also referred to as ink) may be available. A common additional color is white, but also varnish and silver-colored and gold-colored ink are well known additional colors. Further, for increasing a print speed it is known to provide multiple print heads per color. In particular, two or more print heads per color may be staggered to form a wider print swath per scanning movement.

With an increasing number of print heads on the carriage 5, a weight of the carriage 5 increases. Inertia increases and resonance frequencies become lower. A too low resonance frequency is undesirable as such low resonance frequency may be close to an operating frequency. Consequently, such resonance frequency may become excited and distort/disrupt the operation of the inkjet printer. In order for the carriage 5 to support more print heads, it is desirable to reduce the weight of any other component. For example, a carriage plate for supporting the print heads may be reduced in weight by thinning the carriage plate.

Figure 2A:
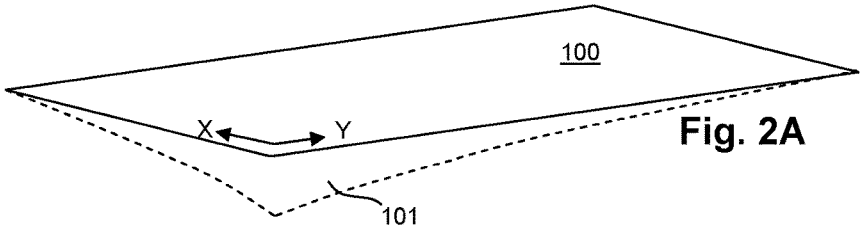
FIG. 2A-2B each schematically show a plate-like element with an internal degree of freedom, i.e. a degree of freedom with respect to its shape.
Figure 2B:
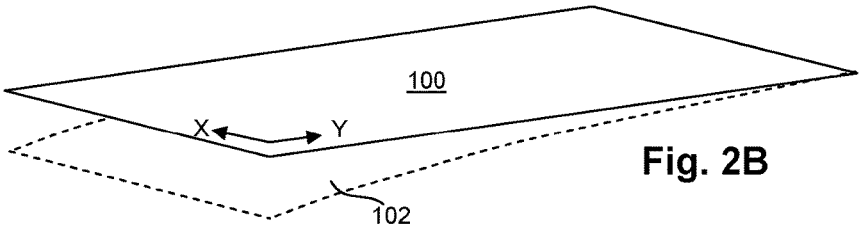

FIG. 2A illustrates a flat plate-like element 100. The plate-like element 100 extends in two directions, in particular in an X-direction and in a Y-direction, wherein the Y-direction is perpendicular to the X-direction. Due to machining for thinning, during which machining the plate-like element 100 was clamped, the actual resulting plate-like element 101 is warped. In such warped state, any print head mounted on such plate-like element 101 as a carriage plate will be positioned skewed and will therefore expel droplets in a skewed direction, resulting in inaccurately positioned dots. FIG. 2B illustrates a similar plate-like element 100. In FIG. 2 it is illustrated that the plate-like element 100 may actually be a bent plate-like element 102.

The warped plate-like element 101 and the bent plate-like element 102 may be considered to have an internal degree of freedom. The internal degree of freedom relates to the shape of the plate-like elements 101, 102. Controlling and constraining this internal degree of freedom enables to flatten/straighten the plate-like elements 101, 102 to a desirable flat plate-like element 100. Thereto, the plate-like element 101, 102 need to be compliant to a predetermined extent.

For example, referring to FIG. 2A, constraining the plate-like element 101 at four positions should lead to a change in the shape of the plate-like element 101. If the compliancy of the plate-like element 101 is insufficient and, thus, the plate-like element 101 is too stiff, the use of four support positions will lead to an over-constrained assembly, which is difficult to handle and results in undesirable stress in the assembly. On the other hand, if the compliancy is too large, other curves and curvatures will remain and the plate-like element 101 will not become flat and straight.

Figure 3A:
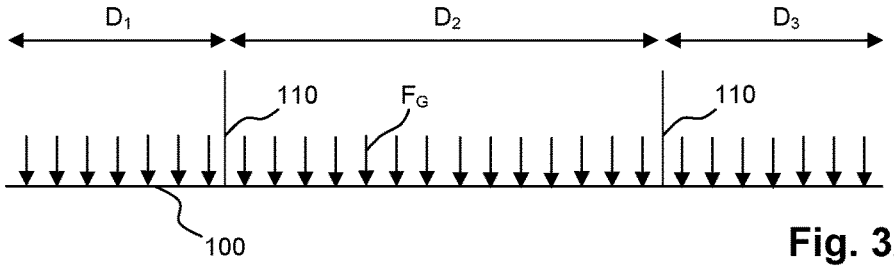
FIG. 3A-3D schematically illustrate how a weight distribution affects a shape of a compliant plate-like element.
Figure 3B:
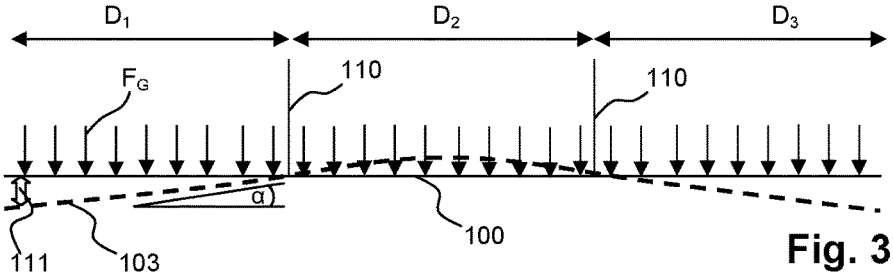
Figure 3C:
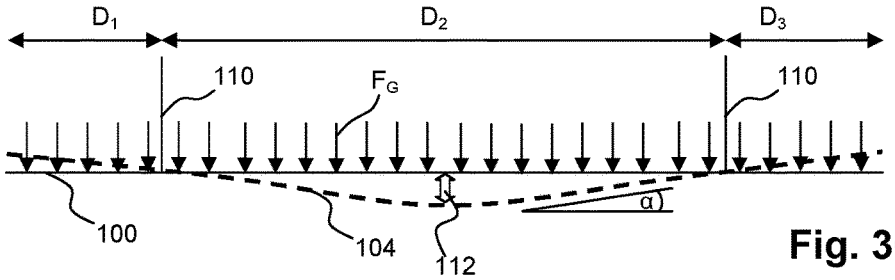

Referring to FIG. 3A, the flatness and straightness of a compliant plate-like element 100 is not only depending on its own rigidity and shape, but also on the weight supported by the plate-like element 100 and the distribution of weight on the plate-like element 100, in particular the weight distribution relative to support positions of the plate-like element 100. In FIG. 3A-3C, a plate-like element 100 is supported (suspended) at its support positions by two support structures 110. There is a distance $D_1$ from a left-hand side of the plate-like element 100 to the first support structure 110 and there is a distance $D_3$ from a right-hand side of the plate-like element 100 to the other support structure 110. Between the two support structures 110, there is a distance $D_2$. In FIG. 3A-3D, it is presumed that an equally distributed weight is provided on the plate-like element 100, which weight is represented by arrows $F_G$ (force of gravity). In a practical embodiment, the weight distribution may not be equally distributed. Such unequally distributed weight may affect the desired positions of the support structures 110, but it lies within the ambit of the skilled person to determine such adapted positions based on the below teachings related to FIG. 3A-3D.

In FIG. 3A, the distances $D_1$, $D_2$ and $D_3$ have been suitably selected such that the plate-like element 100 is forced into a substantially flat shape. In FIG. 3B, the distance D2 between the two support structures 110 is smaller than in FIG. 3A. Consequently, the weight on the plate-like element 100 in the end portions (i.e. in the range of distance $D_1$ and in the range of distance $D_3$) is increased, while in the center portion (in the range of distance $D_2$) the weight is reduced. Due to the compliancy of the plate-like structure 100, the end portions tend to bend downwards, while the stiffness of the plate-like element 100 simultaneously forces the center portion to bend upwards. A resulting shape 103 of the plate-like element 100 has an angle $\alpha$ relative to a desired horizontal line, while the ends of the plate-like element 100 deviate in their positions over an end height deviation 111. As a result, a print head (not shown, but represented by the arrows $F_G$) is arranged under the angle $\alpha$ and droplets are expelled in an undesired direction. Further, a distance between the plate-like element 100 and a recording medium support surface differs over the length of the plate-like element 100. Consequently, a time of flight of droplets differs over the length of the plate-like element 100. Both aspects, i.e. the angle $\alpha$ and the differing time of flight, result in a deterioration of image quality.

FIG. 3C illustrates a similar situation, wherein the distance $D_2$ has been increased relative to the situation illustrated by FIG. 3A. In this embodiment, the weight in the center portion results in a center height deviation 112 and the stiffness of the plate-like element 100 forces the ends upwards.

A predetermined amount of height deviation and angular deviation may be acceptable. The specific amount is primarily determined by an image quality level that is deemed acceptable. If the image quality that is deemed acceptable is relatively low, the acceptable level of height deviations and related angular deviations increases. Based on the acceptable levels of deviations, the compliancy and the stiffness of the plate-like element 100 may be selected taking into account the weight and weight distribution and the position of the support structures 110.

Figure 3D:
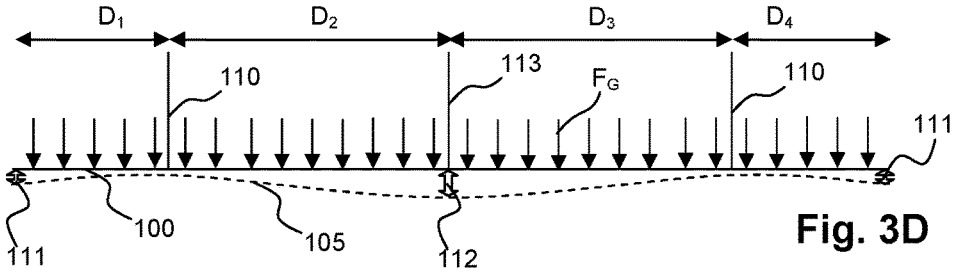

FIG. 3D illustrates an embodiment having a plate-like element 100 with an even higher compliancy. Considering only two support structures 110, due to the relatively high compliancy, the plate-like element 100 deforms even more easily as illustrated by the shape 105. In particular, the end portions ($D_1$ and $D_4$) bend downwards and have an end height deviation 111 to a maximum level. Still, in the center of the plate-like element 100 bends also downwards to a level of the center height deviation 112, which exceeds the maximum level. To correct this excessive center height deviation 112, an additional support structure 113 may be introduced. Such an additional internal degree of freedom and the corresponding additional support structure 113 increase the complexity of calibration of position and shape of the plate-like element 100. Moreover, the weight of the additional support structure 113 needs to be less than additional weight for stiffening the plate-like element 100 to achieve weight reduction in order to be advantageous for operational control and speed.

Figure 4A:
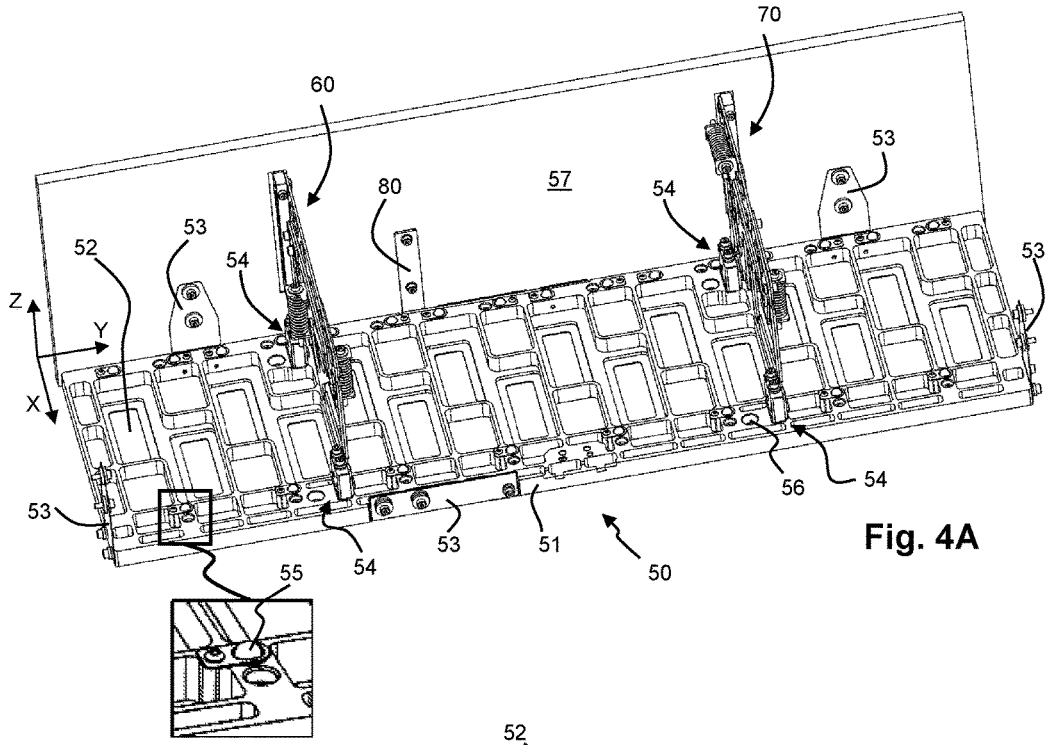
FIG. 4A shows a perspective view of a print head support assembly according to the present invention.
Figure 4B:
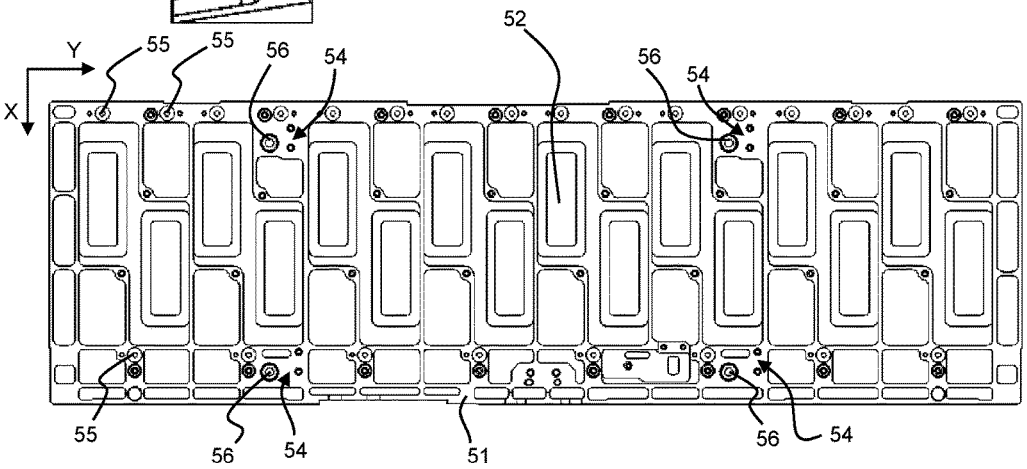
FIG. 4B shows a top view of a carriage plate used in the print head support assembly shown in FIG. 4A.

FIG. 4A shows a practical embodiment of a print head support assembly 50 having a compliant carriage plate 51. The carriage plate 51 is provided with sixteen print head recesses 52, wherein each print head recess 52 is provided with a through hole for expelling droplets. The carriage plate 51 is positioned and suspended by a support sub-assembly comprising a first support structure 60, a second support structure 70 and a linkage 80. The carriage plate 51 is coupled to a carriage frame plate 57 through coupling elements 53. Further coupling elements 53 are provided for coupling to further carriage frame elements (not shown). The first and second support sub-assemblies 60, 70 are coupled to the carriage plate 51 at four support positions 54. Print heads may be mounted on the carriage plate 51 and positioned by suitable reference balls 55 (as illustrated in an enlarged part of FIG. 4A). Further, near each support position 54, a measurement structure, in particular a gauge recess 56, is provided. The use of the gauge recesses 56 is elucidated below with reference to FIG. 7. Many of the above described elements shown in FIG. 4A are also illustrated in FIG. 4B, which shows the same carriage plate 51 in top view.

Figure 5A:
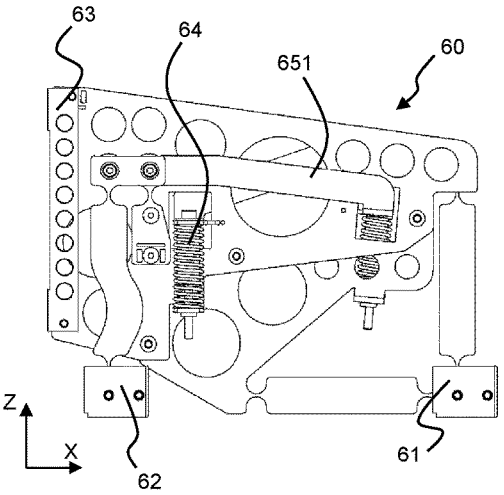
FIG. 5A shows a first side view of a first support assembly used in the print head support assembly shown in FIG. 4A.
Figure 5B:
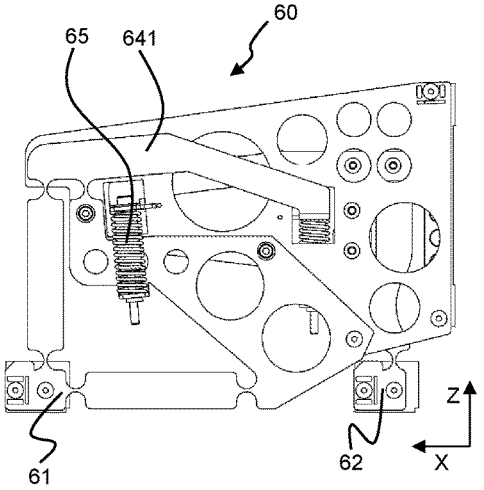
FIG. 5B shows a second side view of the first support assembly shown in FIG. 5A.

FIGS. 5A and 5B show—in opposing side views—the first support structure 60 having a first mounting point 61 and a second mounting point 62 corresponding with two of the support positions 54 of the carriage plate 51. The first support structure 60 is provided with a mounting element 63 for mounting on the carriage frame plate 57. The position of the first mounting point 61 is adjustable through a first adjustment element 64 coupled to the first mounting point 61 via a first adjustment lever 641. The position of the second mounting point 62 is adjustable through a second adjustment element 65 coupled to the second mounting point 62 via a second adjustment lever 651.

Figure 6A:
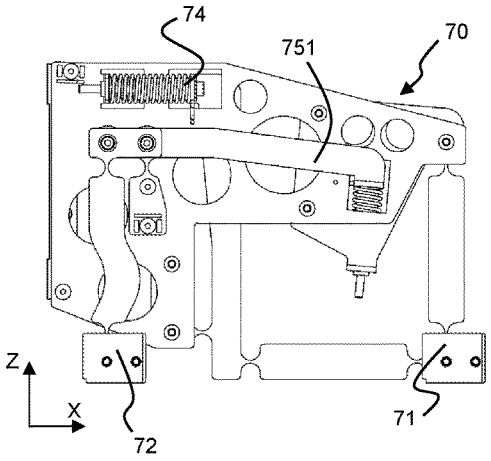
FIG. 6A shows a first side view of a second support assembly used in the print head support assembly shown in FIG. 4A.
Figure 6B:
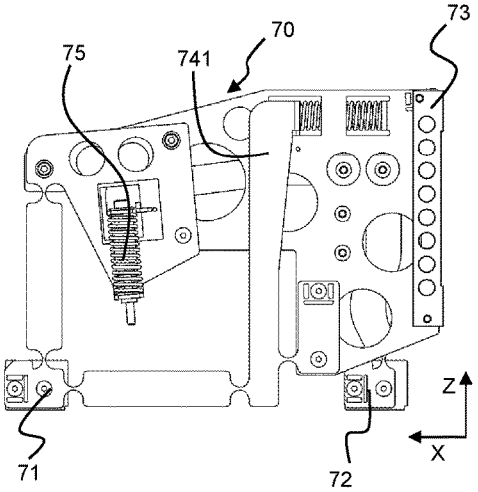
FIG. 6B shows a second side view of the second support assembly shown in FIG. 6A.

FIGS. 6A and 6B show—in opposing side views—the second support structure 70 having a third mounting point 71 and a fourth mounting point 72 corresponding with two of the support positions 54 of the carriage plate 51. The second support structure 70 is provided with a mounting element 73 for mounting on the carriage frame plate 57. The position of the third mounting point 71 is adjustable through a third adjustment element 74 coupled to the third mounting point 71 via a third adjustment lever 741. The position of the fourth mounting point 72 is adjustable through a fourth adjustment element 75 coupled to the fourth mounting point 72 via a fourth adjustment lever 751.

Referring to FIGS. 4A-4B, 5A-5B and 6A-6B, in accordance with the present invention, the carriage plate 51 is held in position and shape by four independently adjustable mounting points. Supporting the carriage plate 51 at three support positions 54 would allow to control the position of the carriage plate 51 in six degrees of freedom: translations in X-direction, Y-direction and Z-direction (Tx, Ty, Tz) and rotations around the X-direction, Y-direction and Z-direction (Rx, Ry, Rz). The fourth support position allows controlling an internal degree of freedom.

The carriage plate 51 is a machined plate. The plate was originally a thick plate and then a significant part of the material has been removed by milling and drilling to form the print head recesses 52 and other recesses, leaving only a number of ribs between such recesses. The ribs provide for a certain amount of stiffness, but the recesses in the carriage plate 51 are so deep that the carriage plate 51 has also become compliant. Moreover, after machining, the carriage plate 51 is usually in a warped state, wherein the amount of deviation due to the warping is undefined and not a priori known.

Note that the present invention is not limited to machined carriage plates. The present invention is applicable to any carriage plate 51 being compliant, i.e. insufficiently stiff, and thus having an internal degree of freedom that may be controlled by the fourth support position.

The carriage plate 51 is mounted in the carriage through the first support structure 60 and the second support structure 70. The first and second support structures 60, 70 are each suspended on the carriage frame plate 57. The carriage plate 51 is connected at each support position 54 to a respective one of the four mounting points 61, 62, 71, 72 of the first and second support structures 60, 70. The adjustment elements of the first and second support structures 60, 70 enable to adjust the relative positions of the four mounting points 61, 62, 71, 72 and consequently of the support positions 54.

After mounting of the carriage plate 51, the position and shape of the carriage plate 51 may be controlled through the adjustment elements 64, 65, 74, 75. In particular, the adjustment elements 65, 75 are configured to adjust a Z-position of the second and fourth mounting points 62, 72 through the respective adjustment levers 651, 751. An adjustment of the Z-position (Tz) of the second and fourth mounting points 62, 72 also adjust a rotation around the Y-axis (Ry), also referred to as the roll of the carriage plate 51. If only one of the second and fourth mounting points 62, 72 is adjusted in Z-direction, the shape of the carriage plate 51 is adjusted and in particular a warping of the carriage plate 51 is changed.

The adjustment elements 64, 65 are configured to adjust a Z-position of the first and second mounting points 61, 62 through the respective adjustment levers 641, 651. An adjustment of the Z-position (Tz) of the first and second mounting points 61, 62 also adjust a rotation around the X-axis (Rx), also referred to as the tilt of the carriage plate 51. If only one of the first and second mounting points 61, 62 is adjusted in Z-direction, the shape of the carriage plate 51 is adjusted and in particular a warping of the carriage plate 51 is changed.

The adjustment element 74 is configured to adjust a X-position of the third mounting point 71 through the respective adjustment lever 741. An adjustment of the X-position (Tx) of the third mounting point 71 also affects the X-position of the fourth mounting point 75 and adjusts a rotation around the Z-axis (Rz), also referred to as the yaw of the carriage plate 51.

Figure 1C:
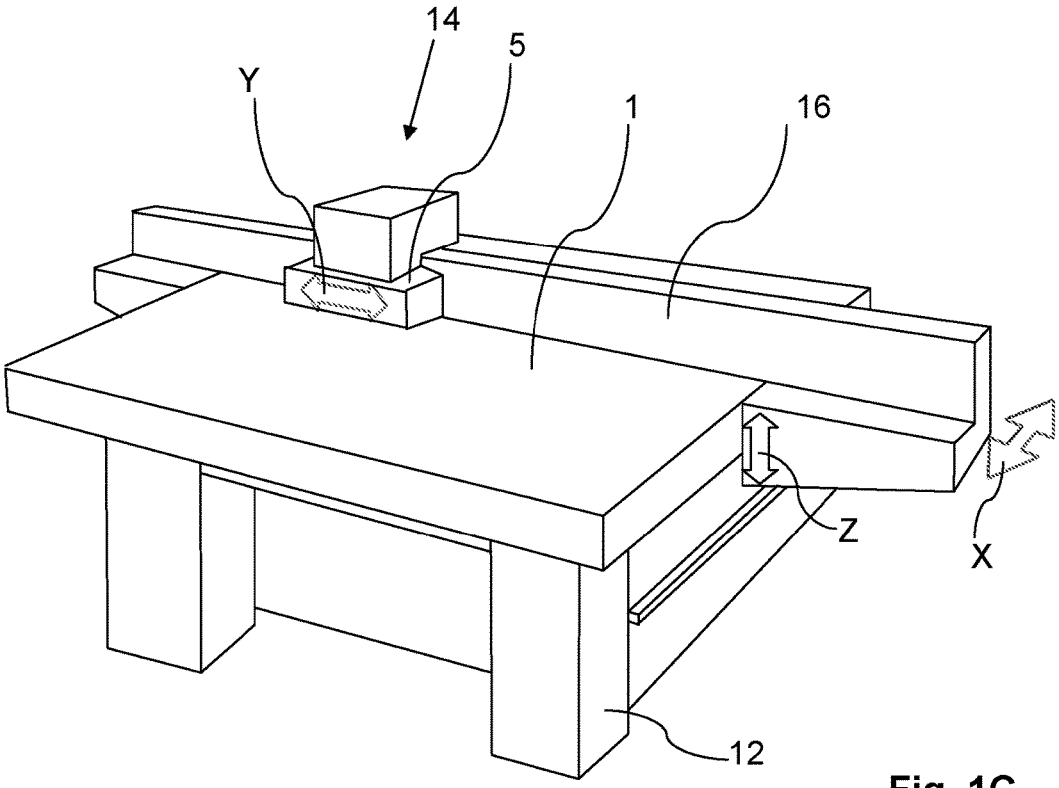

It is noted that the above described translations and rotations by adjustment of the adjustment elements 64, 65, 74, 75 are all relative to the carriage frame plate 57. Translations in the X-direction (Tx) and in the Y-direction (Ty) of the carriage plate 51 as a whole are irrelevant, since the specific translational position of the carriage plate 51 is controllable in the Y-direction (Ty) through the position of the carriage 5 relative to the guide means 6, 7 (see FIG. 1B) or the gantry 16 (see FIG. 1C) and controllable in the X-direction (Tx) through the relative medium position (direction A in FIG. 1B) or the gantry X-position (see FIG. 1C).

Further, the illustrated embodiment is very suitable for correcting a warped state, but less suitable for correcting a bent state of the carriage plate 51. For correcting a bent state of the carriage plate 51, it is advised to shift the first and/or the third mounting points 61, 71 and the corresponding support positions 54 in the Y-direction relative to the other mounting points 62, 72 and their respective support positions 54. This will allow better control over the bent state, but may be less suitable for controlling a warped state.

The first and second support structures 60, 70 are not configured to constrain the Y-position of the carriage plate 51 relative to the carriage frame plate 57. Therefore, an additional linkage 80 is provided between the carriage frame plate 57 and the carriage plate 51. The linkage 80 is configured to only constrain the Y-position (Ty).

After mounting and calibrating the position, orientation and shape of the carriage plate 51 relative to the carriage frame plate 57, additional coupling elements 53 are connected between the carriage plate 51, the carriage frame plate 57 and other carriage frame elements (not shown) for forming a stiff carriage frame construction. It is noted that these coupling elements 53 are designed and configured not to change or constrain a position or shape of the carriage plate 51, but merely to form a stiff carriage frame construction together with the coupled carriage frame elements such as the carriage frame plate 57.

Figure 7:
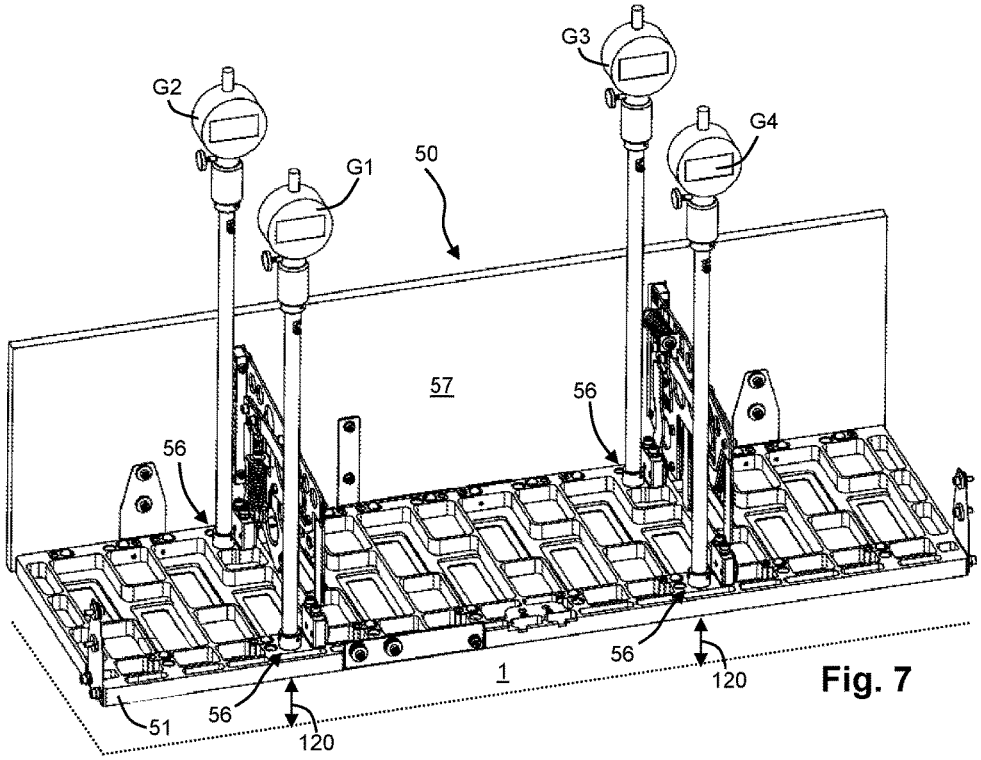
FIG. 7 shows a perspective view of the print head support assembly of FIG. 4A including calibration tools.

FIG. 7 illustrates an embodiment for calibrating the position and shape of the carriage plate 51. In FIG. 7, the carriage plate 51 is shown with four gauges G1-G4. The four gauges are arranged in the four respective gauge recesses 56. The gauges G1-G4 are arranged such that they indicate a distance 120 between the carriage plate 51 and a surface below the carriage plate 51. Such surface is usually the platen 1 or the medium support surface 1 (FIGS. 1B and 10, respectively). Adjusting the adjustment elements 64, 65, 75 until all gauges G1-G4 indicate a same distance 120 results in the carriage plate 51 being parallel to the medium support surface 1 and being flat and straight (presuming a flat and straight medium support surface 1).

A test print using print heads supported on the carriage plate 51 enables to verify the calibrated position, flatness and straightness. Further the test print may be used to determine the yaw. Based on the test print, the yaw may be adjusted through adjusting the adjustment element 74 as above described.

This adjustment method does not only enable a compliant light-weight carriage plate 51, but it further provides for a highly accurate carriage plate 51 providing an improved image quality compared to prior art stiff carriage plates that are machined to be flat and straight without any reference to the medium support surface 1 of the inkjet printer. The above described method ensures an accurate shape and position relative to the medium support surface 1.

Figure 8A:
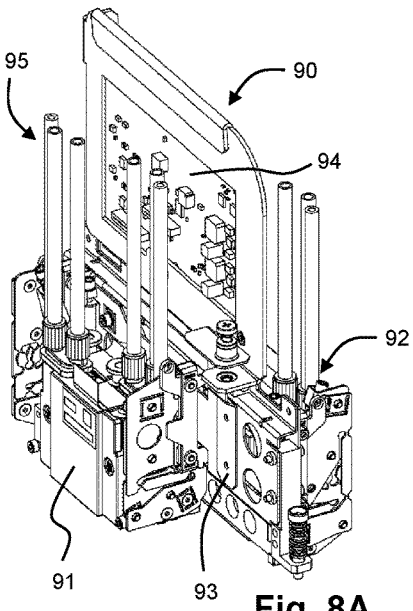
FIG. 8A shows a perspective view of a staggered row of print heads arranged on a blade assembly for use with the print head support assembly of FIG. 4A.

FIG. 8A shows a two row print head blade assembly 90 holding a first print head 91 and a second print head 92. The print heads 91, 92 are held in position relative to a blade 93. The print heads 91, 92 are mounted such that their orientation relative to the blade 93 is adjustable and may be calibrated outside the print head support assembly 50 (see e.g. FIG. 8B). On the blade 93, a print head driver circuitry board 94 is provided for driving the two print heads 91, 92. Further, ink supply tubing 95 is provided for supplying ink to the print heads 91, 92. The print head blade assembly 90 enables to register the two print heads 91, 92 relative to each other such that they form virtually a single print head. Such construction is known in the art and is not further elucidated herein.

Figure 8B:
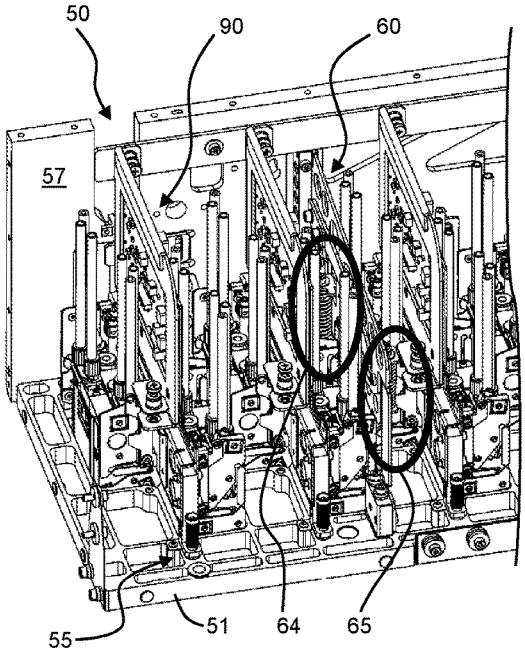
FIG. 8B shows a perspective view of the staggered row of print heads of FIG. 8A arranged on the print head support assembly according to FIG. 4A.

As illustrated in FIG. 8B, the print head blade assembly 90 may be mounted on the carriage plate 51 and be positioned relative to the carriage plate 51 based on the reference balls 55. In particular, for each print head blade assembly 90, three reference balls 55 are provided such that all degrees of freedom may be properly constrained and adjusted, where needed.

As apparent from FIG. 8B, the first support structure 60 is designed such that the adjustment elements 64, 65 may be operated even when the print head blade assemblies 90 are mounted on the carriage plate 51. This enables to adjust position and shape of the carriage plate 51 with the print heads mounted thereon, which further improves the accuracy of the position and shape of the carriage plate 51 during operation of the inkjet printer.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A print head support assembly for carrying a plurality of print heads and for positioning the plurality of print heads relative to each other, the print head support assembly comprising:

a carriage plate for supporting the plurality of print heads and provided with reference elements for positioning the plurality of print heads relative to each other, the carriage plate being further provided with at least four support positions at which the carriage plate is supported or suspended; and a support sub-assembly supporting the carriage plate, wherein the support sub-assembly is provided with at least four mounting points, wherein the carriage plate is connected at each support position to a respective one of the mounting points;

wherein the support sub-assembly is configured to constrain the carriage plate in six degrees of freedom with respect to a position of the carriage plate and to constrain the carriage plate in at least one degree of freedom with respect to a shape of the carriage plate, and wherein the respective positions of the mounting points are adjustable for adjusting the shape of the carriage plate.

2. The print head support assembly according to claim 1, wherein a position of at least three of the mounting points is adjustable for adjusting the position and the shape of the carriage plate.

3. The print head support assembly according to claim 2, wherein the support sub-assembly comprises a first support structure providing for two adjustable mounting points and a second support structure providing for two adjustable mounting points.

4. The print head support assembly according to claim 3, wherein the plurality of print heads is arranged on the carriage plate in a number of staggered rows, each row comprising at least one print head and extending in a row direction, and wherein the two adjustable mounting points of at least one of the first and second support structure are arranged on a virtual line parallel to the row direction.

5. The print head support assembly according to claim 1, wherein the at least one degree of freedom with respect to the shape allows the carriage plate to be warped and wherein the support sub-assembly is configured to constrain the carriage plate in a substantially flat shape for correcting such warped state.

6. The print head support assembly according to claim 5, wherein the plurality of print heads and the at least four support positions are arranged relative to each other such that a static weight distribution exerted on the carriage plate by a mass of the plurality of print heads forces the carriage plate into a substantially flat shape.

7. The print head support assembly according to claim 1, wherein the at least one degree of freedom with respect to the shape allows the carriage plate to be bent and wherein the support sub-assembly is configured to constrain the carriage plate in a substantially flat shape for correcting such bent state.

8. The print head support assembly according to claim 7, wherein the plurality of print heads and the at least four support positions are arranged relative to each other such that a static weight distribution exerted on the carriage plate by a mass of the plurality of print heads forces the carriage plate into a substantially flat shape.

9. An inkjet printer provided with the print head support assembly according to claim 1, wherein the inkjet printer comprises a recording medium support surface, a carriage guiding structure and a carriage arranged to be moveable along the carriage guiding structure over the recording medium support surface, the print head support assembly being mounted in the carriage and being mechanically coupled to the carriage by at least one coupling element.

10. The inkjet printer according to claim 9, wherein the carriage plate is provided with measurement structures for enabling a measurement of a distance between the carriage plate and the recording medium support surface.

11. The inkjet printer provided with a print head support assembly according to claim 1, wherein the inkjet printer comprises a recording medium support surface and a carriage stationary arranged over the recording medium support surface, the print head support assembly being mounted in the carriage and being mechanically coupled to the carriage by at least one coupling element.

* * * * *